US005293929A

United States Patent [19]

Smith

[11] Patent Number: 5,293,929

[45] Date of Patent: Mar. 15, 1994

[54] COOLING APPARATUS FOR MACHINE PARTS SUCH AS PUMP SEALS

[76] Inventor: Roger D. Smith, 15870 41st La., Loxahatchee, Fla. 33470

[21] Appl. No.: 841,670

[22] Filed: Feb. 21, 1992

[51] Int. Cl.[5] ..... F01D 5/00; F01D 5/08; F04D 13/08; F04D 29/12

[52] U.S. Cl. ..... 165/47; 415/179; 415/180; 417/367

[58] Field of Search ..... 165/47; 415/180, 177; 417/367, 368, 373

[56] References Cited

U.S. PATENT DOCUMENTS

| | | | |
|---|---|---|---|
| 2,556,435 | 6/1951 | Moehrl et al. | 417/367 |
| 2,598,547 | 5/1952 | Ivanoff | 415/175 |
| 2,764,943 | 10/1956 | Peters | 417/373 |
| 2,824,759 | 2/1958 | Tracy | 415/175 |
| 3,371,613 | 3/1968 | Dahlgreen et al. | 417/368 |
| 3,474,734 | 10/1969 | Stogner | 415/175 |
| 5,156,523 | 10/1992 | Maier | 415/180 |

OTHER PUBLICATIONS

"Seal Saver" brochure (no date).

"Asbestos free Sealing Products" brochure of Garlock Corp. p. 45 (no date).

*Primary Examiner*—John K. Ford

[57] ABSTRACT

Cooling apparatus for removing heat generated by friction between machine parts located within a liquid confining enclosure, for example, a seal surrounding the drive shaft of a motor driven pump used for below-ground pumping of sewage, the apparatus comprising a baffled chamber of novel construction which may be mounted on the pump motor housing and cooperates with a tubular heat exchanger, for automatic circulation, in closed circuit, of hot cooling liquid from the seal to the chamber, where it circulates in an orbital motion by virtue of the baffle arrangement, then passes to the tubular heat exchanger, and from there to the seal to cool it.

18 Claims, 1 Drawing Sheet

COOLING APPARATUS FOR MACHINE PARTS SUCH AS PUMP SEALS

BRIEF SUMMARY OF THE INVENTION

The invention relates to closed circuit cooling apparatus for removing heat generated by friction between machine parts located within a liquid confining enclosure, finding particular utility in preventing overheating of the seal between a motor and a pump driven by the motor. Large numbers of such pumps are used in below-ground sewage handling facilities. The novel apparatus, which may be mounted on the motor, automatically circulates cooling liquid in a closed circuit, directing cooling liquid heated in the seal enclosure to heat dissipating means which includes a chamber of novel construction mounted above the seal and then back, in cooled condition, to the seal. The chamber contains baffle means which causes circulation of the cooling fluid orbitally in the chamber in the course of passing downwardly to heat exchange means. If the apparatus is mounted on the pump motor, the chamber and heat exchange means may be configured to conform to the outer shape of the motor housing, which is usually round, hence the chamber in such construction has a concave inner wall and the heat exchange means is similiarly configured.

Clean liquid is used in the apparatus so there is no danger of clogging the flow of cooling liquid to and from the seal. Seals used in below ground sewage pumps cost from $400 each and upward, depending on shaft size. At present, liquid sewage itself from the pump is used as the cooling liquid in many pumps. Because of solids in the sewage, blockage of the flow to the seal is a common occurrence. The seals then overheat and disintegrate, whereupon two men must go into a small space many feet below ground to disconnect the motor and pump assembly and bring it to the surface for installation of a new seal and often also a new pump shaft. The present invention substantially eliminates this problem.

Cooling apparatus advertised by Garlock, Inc. of Palmyra, N.Y. and by Southern Mechanical Seal, Inc. of Miramar, Fla., appears to direct a continuous or metered stream of outside cooling water to pump seals and the like. Such apparatus requires a continuous supply of fresh cooling water from outside the apparatus, or periodic refilling of a large tank, and does not involve automatic recirculating of cooling liquid as in the present invention. The water is those apparatus may perform more of a lubricating function than a cooling function.

In one Florida county alone there are over 3,000 below-ground sewage pumps. Sewage in an area is collected in a below-ground tank. Several of these tanks are connected in series and sewage is pumped from each to the next in line. After passing through several tanks the sewage is pumped to a treatment facility. Thus it will be apparent that use of the present invention carries with it substantial savings when compared with the expense of frequently replacing seals on the numerous below-ground pumps. Seals cost from $400 up.

A seal cooler made in accordance with the invention has operated faultlessly for several months in a test on a working sewage pump, and therefore is expected to operate indefinitely without service. Pump seals cooled by sewage can be expected to require replacement within as little as a few weeks.

In the following specification the invention is described in a preferred embodiment for use on below-ground sewage pumps, and for a particular range of pump sizes. This is not to be taken as limiting the invention to such installations, as it finds utility in a broad range of apparatus for removing heat generated by friction, for example, in a bearing installation. The specification is to be read in conjunction with the appended drawing in which the Figures are not drawn to scale, and have parts enlarged for clarity.

Figure 1:
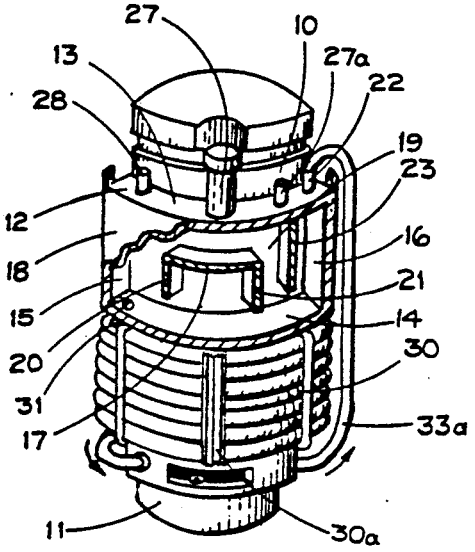
FIG. 1 is a perspective view showing a cooling apparatus made in accordance with the invention mounted on the side of a pump motor and connected to the seal enclosure, a portion of the front wall of the novel chamber being broken away to show the important and novel baffle arrangement inside the chamber, and only a few of the heat exchanger fins being shown.
Figure 4:
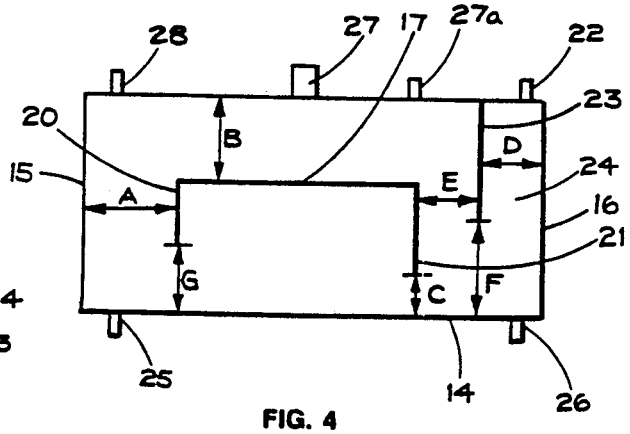
FIG. 4 is a sectional view taken on line 4—4 of FIG. 3.

Referring now to FIG. 1, the motor housing of a pump is shown at 10, the pump portion being at 11. A closed chamber 12, unique in construction, is formed by upper and bottom walls 13 and 14, with end walls 15 and 16 and arcuate front and back walls 18 and 19. Within the chamber is baffle means comprising a first baffle 17 which is generally horizontal and parallel to the top and bottom walls, and is closer to upper wall 13 than to bottom wall 14. See FIG. 4 for more detail. The baffle means functions to direct the incoming hot liquid orbitally around the interior of the chamber, as will be explained in more detail below. Second and third baffles 20 and 21 extend downwardly from the respective ends of baffle 17, leaving spaces "G" and "C", respectively, between their lower ends and bottom wall 14. In order to achieve automatic circulation of the cooling liquid, it is important that distance "G" be at least approximately twice as great as distance "C". The baffles extends the full width of the chamber and are attached to the front and back walls.

The right end of the upper wall 13 of the chamber, as viewed in the drawings, has an inlet connection 22. A fourth baffle 23 extends downwardly from the upper wall at least half the distance between upper wall 13 and bottom wall 14. The lower end of baffle 23 is spaced a substantial distance from the bottom wall. Baffle 23 is located approximately half way between end wall 16 and third baffle 21 and provides a channel 24 for directing the incoming hot liquid entering through inlet 22, downwardly toward bottom wall 14, whence it flows upwardly between baffle 23 and baffle 21.

An outlet connection 25 is located in bottom wall 14 near the chamber end opposite inlet connection 22. Bottom wall 14 also has a drain 26 which is capped during operation. A filling opening 27 is located in the upper wall, as is a connection 28 for a pressure gauge and a connection 27*a* for a pressure release valve, the gauge and valve being used during testing.

As shown in FIG. 1, heat exchanger means 30 in the form of elongate, finned metal tubing 30 is positioned below chamber 12. A few of the fins are indicated at 30*a*. The inlet end of the tubing is connected at 31 to outlet 25 and the outlet end of the tubing is connected via inlet 32 (FIG. 2) to the space around the seal to be cooled. Outlet 33 from the seal space is connected to inlet 22 of chamber 12 by tube 33*a*.

Figure 3:
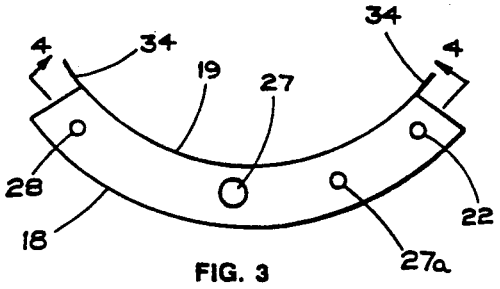
FIG. 3 is a top plan view of the chamber construction.

In the embodiment shown, the motor housing is circular in cross section and chamber 12 is arcuate so as to fit closely about the exterior of the motor housing. Straps are indicated at 34 in FIG. 3 for holding the chamber on the motor housing. The tubular heat exchanger 30 is similarly configured and attached to the housing.

Figure 2:
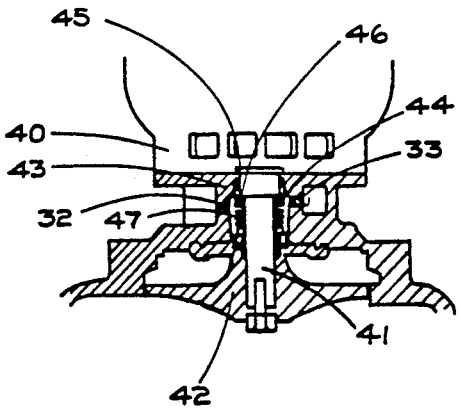
FIG. 2 is a detail sectional view showing the seal location.

FIG. 2 shows a portion of the motor housing and pump, with the seal between the two. The seal prevents liquid being pumped, such as sewage, from escaping into the motor or to the exterior. The lower end of the motor housing is shown at 40, with its rotating shaft 41 extending downwardly to drive a pump, a portion of which is indicated at 42. A connecting housing between the motor housing and pump housing is shown at 43. It surrounds a seal shown at 44 and provides a liquid confining enclosure around the seal for receiving cooling liquid. The liquid enters and exits through openings 32 and 33, respectively, exit opening 33 being above, that is, at a higher elevation or level, than inlet opening 32. The motor in its housing, with pump attached, stands several feet high and weighs several hundred pounds.

The seal comprises upper and lower ceramic rings, each cooperating with a plastic ring, as shown at 45 and 46. The rings are forced apart by a heavy spring 47. If the plastic and ceramic rings become overheated, the ceramic rings break and the plastic rings are distorted, resulting in binding and often scoring the shaft. This results in leakage of the sewage into the space surrounding the pump and/or into the motor.

OPERATION

In operation, after the chamber and tubing are attached to the motor housing, the connections as described above are made and the unit, including the seal housing, is filled with clean water or other appropriate cooling liquid, after which the inlet is capped and the unit tested under pressure for leaks.

When the pump is operated, the seal area becomes heated due to friction and heats the water in the seal enclosure. The thus heated water exits opening 33 because of its higher elevation than opening 32, and passes through tube 33*a* to chamber inlet 22. Cooled water passes from heat exchanger 30 to inlet 32 to the seal enclosure. Thus a continuous circulation takes place automatically without mechanical aid.

As the heated water enters inlet 22 it passes downwardly toward bottom wall 14 of the chamber and then upwardly into the space between baffle 21 and baffle 23. It then passes to the left above baffle 17, and then downwardly between end wall 15 and baffle 20. Part of the liquid exits through outlet 25 to the tubing, but most of it orbits under baffle 20 into the space below baffle 17 and then under baffle 21 and upwardly between baffle 21 and baffle 23, joining hot liquid entering through inlet 22.

This orbiting action caused by the baffle arrangement is important to successful operation, as cooling takes place in chamber 12 as a result, while cooling also takes place in heat exchanger 30. It will also be seen that the orbiting action of the liquid helps maintain the flow, which occurs without any pump or other assistance.

In the embodiment of the invention used on a 1 to 100 horsepower motor in the test installation mentioned above, and referring now to FIGS. 3 and 4, chamber 12 is of sheet aluminum with welded joints. Front and back walls 18 and 19 are 3 inches apart and back wall 19 adjacent the motor housing is curved on an 18 inch radius and has a length of approximately 14⅜ inches. The chamber is 8 inches high. The distance "A" is 3½ inches; distance "B" is 3¼ inches; distance "C" is 1 inch; distance "D" is 2 inches; distance "E" is 2 inches; distance "F" is 2 inches; and distance "G" is 2 inches. Inlet 22 is a ¼ inch pipe; pressure release connection 27*a* is ½ inch pipe; gauge connector 28 is ⅜ inch pipe; outlet 25 is ½ inch pipe; drain 26 is ⅜ inch pipe; filling connection 27 is 2 inch pipe.

Heat exchanger 30 is of ¼ inch inner diameter aluminum tubing having a length of approximately 24 feet, with aluminum fins 30*a*. In this example threaded connections are used for the tubing and connecting lines. For larger motor sizes, stainless steel is preferred to aluminum for chamber 12.

Chamber 12 and heat exchanger 30 operate in combination to achieve the necessary convective flow of cooling liquid. Neither the chamber nor the heat exchanger, used alone, has been found to provide the cooling liquid flow obtained by the combination. The orbital flow of liquid in the chamber with its baffle means, and the ratio of "G" to "C" being at least 2:1, are important features of the invention and the operation of the overall combination.

It will be understood that I have described a preferred embodiment of the invention and that the invention is susceptible of variations within the scope of the appended claims. For example, the apparatus does not have to be mounted on a motor housing or used below ground, but can be mounted separately in proximity to the device to be cooled, with the chamber located higher than the machine part being cooled. Also, a single apparatus can be used for cooling several devices by means of appropriate connections. Larger size apparatus is used for cooling higher horsepower devices. As explained above, the invention is useful with various other types of friction generating machine parts.

I claim:

1. Cooling apparatus for removing heat generated by friction between machine parts located within a liquid confining enclosure, said enclosure having liquid inlet and outlet openings, said outlet opening being located above said inlet opening, said apparatus providing, when filled with cooling liquid, closed circuit, automatically recirculating heat removal; said apparatus comprising:

metal wall means including an upper wall and a bottom wall forming a closed, liquid receiving chamber for mounting above said enclosure, liquid inlet means in an end portion of said upper wall for receiving heated cooling liquid from the liquid outlet opening of said enclosure, and liquid outlet means in an opposite end portion of said bottom wall, baffle means within said chamber for directing the cooling liquid entering said inlet means into orbital movement within the chamber, and heat exchanger means located below said chamber and comprising elongate means providing a liquid flow path, said elongate means having an inlet connected to said liquid outlet means, and an outlet for connection to the liquid inlet opening of said enclosure.

2. Cooling apparatus as set forth in claim 1, wherein said machine parts comprise a motor driven rotating pump shaft and a seal surrounding the shaft between the motor and the pump, said enclosure being located between the motor and pump and surrounding said shaft and seal.

3. Cooling apparatus as set forth in claim 1, further comprising:

said baffle means comprising a first baffle extending transversely and longitudinally of said chamber and being located closer to said upper wall than to said bottom wall, the ends of said first baffle being spaced from the ends of said chamber, second and third baffles extending downwardly from the respective ends of said first baffle, said second baffle being near said liquid outlet means and being shorter than said third baffle, said third baffle being near said liquid inlet means.

4. Cooling apparatus as set forth in claim 3, further comprising:

a fourth baffle extending downwardly from said upper wall near the inlet end of the chamber and located such that said inlet means is between said fourth baffle and the inlet end of the chamber, said fourth baffle (a) extending at least half the distance from the upper wall to the bottom wall, (b) having its lower end spaced substantially from said bottom wall, and (c) being located generally midway between the inlet end of the chamber and said third baffle, so as to form a channel that directs incoming liquid from said inlet means downwardly toward said bottom wall, the incoming liquid then passing under said fourth baffle and then upwardly between said fourth baffle and said third baffle.

5. Cooling apparatus as set forth in claim 4, the distance from the lower end of said second baffle to said bottom wall being at least approximately twice the distance from the lower end of said third baffle to said bottom wall.

6. Cooling apparatus as set forth in claim 2, further comprising:

said metal wall means including side walls, one of said side walls being shaped to fit closely about said motor.

7. Cooling apparatus as set forth in claim 6, said heat exchanger means being similarly configured to fit closely about said motor.

8. Cooling apparatus as set forth in claim 7, said configuration being arcuate.

9. Cooling apparatus as set forth in claim 1, said metal being aluminum.

10. Cooling apparatus as set forth in claim 1, said metal being stainless steel.

11. Cooling apparatus as set forth in claim 1, wherein said heat exchanger means comprises finned tubing of metal.

12. A closed, liquid receiving chamber structure for use in cooling apparatus for removing heat generated by friction between machine parts located within a liquid confining enclosure, said enclosure having liquid inlet and outlet openings, said outlet opening being located above said inlet opening, said apparatus providing, when filled with cooling liquid, closed circuit, automatically recirculating heat removal, said chamber structure comprising:

metal wall means including an upper wall and a bottom wall, liquid inlet means in an end portion of said upper wall for receiving heated cooling liquid, and liquid outlet means in an opposite end portion of said bottom wall, and baffle means within said chamber for directing the cooling liquid entering said inlet means into orbital movement within the chamber, said baffle means comprising a first baffle extending transversely and longitudinally of said chamber and being located closer to said upper wall than to said bottom wall, the ends of said first baffle being spaced from the ends of said chamber, and second and third baffles extending downwardly from the respective ends of said first baffle, said second baffle being near said liquid outlet means and being shorter than said third baffle, said third baffle being near said liquid inlet means.

13. A construction as set forth in claim 12 further comprising:

a fourth baffle extending downwardly from said upper wall near the inlet end of the chamber and located such that said inlet means is between said fourth baffle and the inlet end of the chamber, said fourth baffle (a) extending at least half the distance from the upper wall to the bottom wall, (b) having its lower end spaced substantially from said bottom wall, and (c) being located generally midway between the inlet end of the chamber and said third baffle, so as to form a channel that directs incoming liquid from said inlet means downwardly toward said bottom wall, the incoming liquid then passing under said fourth baffle and then upwardly between said fourth baffle and said third baffle.

14. A construction as set forth in claim 13, the distance from the lower end of said second baffle to said bottom wall being at least approximately twice the distance from the lower end of said third baffle to said bottom wall.

15. A construction as set forth in claim 14, further comprising:

said metal wall means including side walls, one of said side walls being shaped to fit closely about a pump motor.

16. A construction as set forth in claim 15, wherein said pump motor is circular in cross section, the shape of said one side wall being arcuate.

17. A construction as set forth in claim 12, said metal being aluminum.

18. A construction as set forth in claim 12, said metal being stainless steel.

* * * * *